US007115040B1

(12) United States Patent
Thorson et al.

(10) Patent No.: US 7,115,040 B1
(45) Date of Patent: Oct. 3, 2006

(54) PIT CUSHION FOLLOWER ASSEMBLY

(75) Inventors: Scott J. Thorson, Des Moines, IA (US); Steven Nadolny, Germantown, WI (US); Michael G. Feltz, Milwaukee, WI (US)

(73) Assignee: Pinsetter Parts Plus, LLC, Milwaukee, WI (US)

( * ) Notice: Subject to any disclaimer, the term of this patent is extended or adjusted under 35 U.S.C. 154(b) by 0 days.

(21) Appl. No.: 11/030,820

(22) Filed: Jan. 7, 2005

Related U.S. Application Data

(63) Continuation-in-part of application No. 10/774,096, filed on Feb. 6, 2004.

(51) Int. Cl.
*A63D 5/08* (2006.01)

(52) U.S. Cl. ..... 473/93; 473/114

(58) Field of Classification Search ..... 473/93, 473/112, 114

See application file for complete search history.

(56) References Cited

U.S. PATENT DOCUMENTS 2,297,330 A * 9/1942 Schoepfer ..... 473/112
3,124,354 A * 3/1964 Asmuth ..... 473/93
3,233,901 A * 2/1966 Sandahl ..... 473/93
3,790,167 A * 2/1974 Lenhart et al. ..... 473/93
4,530,501 A * 7/1985 Paster et al. ..... 473/93

OTHER PUBLICATIONS

EBN Cushion Cam Kit, product website, http://www.ebnservices.com/Brunswick%20parts-pg.2.htm, Mar. 27, 2006.*
Brunswick Service Manual, "A-2 Automatic Pinsetter" (12-752828-000) (undated).

* cited by examiner

*Primary Examiner*—William M. Pierce
(74) *Attorney, Agent, or Firm*—Boyle Fredrickson Newholm Stein & Gratz S.C.

(57) ABSTRACT

A pit cushion assembly of an automatic pinsetter is fitted with a pit cushion follower assembly that includes a cam and roller assembly that allows a pit cushion of a pin setting mechanism to move toward and away from a support arm on which the pit cushion is movably mounted without restricting a range of motion of the pit cushion away from the support arm. The cam is operative, upon movement of the pit cushion toward the support arm from an initial position thereof, to ride along the roller while driving the support arm to move. The cam is also operative to permit return movement of the pit cushion to the operative position thereof without restricting the range of pit cushion motion. The cam and roller-based follower assembly allows the pinsetter to operate more efficiently with less moving parts and with less maintenance requirements than with a traditional link-based follower assembly.

13 Claims, 6 Drawing Sheets

PIT CUSHION FOLLOWER ASSEMBLY

CROSS REFERENCE TO A RELATED APPLICATION

This application is a continuation-in-part application of co-pending U.S. application Ser. No. 10/774,096, filed Feb. 6, 2004 and entitled "Pit Cushion Cam and Roller Kit," the entirety of which is incorporated herein by reference.

BACKGROUND OF THE INVENTION

1. Field of the Invention

The invention relates to an automatic bowling pinsetter and, more particularly, to a cam and roller-based pit cushion follower assembly located between a pit cushion and a support arm of a pit cushion assembly of the pinsetter.

2. Discussion of the Related Art

Automatic pinsetters are widely used in bowling alleys to sweep downed pins from bowling lanes during and between frames and to set upright pins in place. Referring to FIG. 1, a pinsetter 20 is illustrated that is Model A-2 pinsetter manufactured by Brunswick Corporation. Pinsetter 20 includes as its major component a rake assembly 22 that sweeps pins from the lane L and into a pit area P located behind the lane, a vertically reciprocating deck (not shown) that sets the pins, and a pit cushion assembly 24 that acts as a backstop for bowling balls. The rake assembly 22 includes a rake sweep board 23 that is driven by a gearbox 26 and a rake lift cam 28, but is biased by a spring 29 to its downward or clockwise rotated position illustrated in phantom lines. Each side of the rake assembly 22 is also coupled to the pit cushion assembly 24 by a lower vertically adjustable link 30, an adjustable upper rake sweep link 32, and a pivoting triangular plate 34. Specifically, each vertical adjustable link 30 is attached to a pit cushion support assembly 44 at its lower end and to a pivoting triangular plate 34 at its upper end. Each upper sweep link 32 extends from the corresponding triangular plate 34 to a "V" lever 36 on a rake lift shaft 38 at the top of the pinsetter 20. The forward end of the left-hand pit cushion link (not shown) is attached to an adjustable link of a rake trip mechanism or "shot gun link" that lowers the rake sweep board 23 to the bowling lane L. Two kickbacks (not shown), one on each side of the bowling lane L, support and serve as mounts for the pinsetter 20. Mounting plates 40 are bolted to the top of the kickbacks.

The pit cushion assembly 24 is suspended across a pit area P behind the lane L to stop the motion of a bowling ball B after the ball passes through the bowling pins and falls into the pit area P. Pit cushion assembly 24 comprises a pit cushion 42 that extends across the lane and two support assemblies 44, one located at each end of the pit cushion, that suspend the pit cushion 42 above the pit area P. The pit cushion 42 comprises a steel plate 50 protected by pads 48 so as not to mark or damage bowling balls. A bottom end of the plate 50 is inclined forwardly relative to the remainder of the plate and is positioned just above the floor of the pit area A when the pit cushion assembly 24 is in its initial or deactivated position shown in solid lines in FIG. 1. A pit curtain 52 extends upwardly from the pit cushion 42 to hide objects behind the pit cushion 42 from view. A vertical mounting arm 48 is mounted on each end of the pit cushion 42 for connection to an associated support assembly 44.

Referring to FIGS. 1–3, each pit cushion support assembly 44 is attached to front and rear support brackets 60 and 62 mounted on the mounting plate 40. The upper end of a support arm 64 is pivotally mounted to each front bracket 60. An airplane type shock absorber 66 is pivotally attached to an intermediate portion of each support arm 64 at one end and to the rear kickback pit cushion-mounting bracket 62 at its opposite end. The shock absorber 66 relieves the sudden rearward motion of the pit cushion upon ball impact.

Referring to FIGS. 2 and 3, the vertical mounting arm 48 on each end of the pit cushion 42 is mounted on the associated support arm 64 by a pair of upper support arms 67 and a lower follower link assembly 68 which, in combination with pivoting movement of the support arm 64, permit the pit cushion 42 to swing upwardly and rearwardly upon ball impact so that a bowling ball B (FIG. 1) can pass under the pit cushion 42 to enter a ball elevator (not shown). They also permit the pit cushion 42 to lower at the end of the operational pinsetter cycle. The upper support arms 67 are pivotally mounted to common pivot points 70, 72 on the upper end of the vertical mounting arm 46 and an intermediate portion of the support arm 64, respectively.

The follower link assembly 68 of each support assembly 44 includes a pair of inclined follower links 74, each of which has an aperture 76 in its lower front end and an elongated slot 78 in its upper rear end. The lower end of the vertical support arm 64 contains a pressed bushing 80 in an aperture 84 thereof that acts as a pivot for the pit cushion 42. Inserted into bushing 80 is a steel spacer 82. Spacer 82 exceeds the length of the pressed bushing 80. Each steel spacer 82 acts as a pivot point for the lower end of the associated follower link 74. Specifically, the spacer 82 receives a ½ inch bolt 86 that pivotally attaches the follower link 74 to the bottom aperture 84 in the mounting arm 46. A uniball 88 is also attached to the bolt 86 for connection to the adjustable vertical link 30. The slot 78 in the upper end of each follower link 74 slidably receives a bushing assembly 90 which is mounted in a bottom aperture 92 in the support arm 64 by a ½ inch bolt 94. Coordinated pivoting of the follower links 74 about the bolts 94 and sliding movement of the bushing assemblies 90 along the slots 78 accommodates swinging movement of the pit cushion 42 relative to the support arms 64. The extent of relative movement of the pit cushion 42 away from the support arms 64 at the end of a return stroke occurring at the end of the pinsetter operational cycle is limited by the bottoming out of the bushing assemblies 90 in the slots 78.

In operation, the impact of a bowling ball B against the pit cushion 42 causes the pit cushion 42 to rotate clockwise and thus push the vertical links 30 upward. This upward movement rotates the triangular plates 34 clockwise, pushing the upper link 32 forward to unlatch the rake trip mechanism or shotgun link and lower the rake sweep board 23 to the bowling lane L. As the rake assembly 22 lowers the sweep board 23, the pit cushion link 32 rotates the triangular plates 34 clockwise and, through the vertical links 30, raises the pit cushion 42 to allow the bowling ball B to pass under the pit cushion 42 to the ball elevator (not shown). During the return stroke of the rake sweep board 23, the pit cushion 42 rotates counterclockwise and pulls the vertical links 30 downward, rotating the triangular plates 34 counterclockwise and moving the pit cushion 42 downward. The pit cushion 42 again is in position to await delivery of the next bowling ball. It can thus be seen that the rake sweep board 23 and pit cushion 42 operate together. When the rake sweep board 23 is down, the pit cushion 42 is up. When the rake sweep board 23 is up, the pit cushion 42 is down.

The follower link assembly 68 is viewed by pinsetter mechanics as an area with a high rate of mechanical failure and maintenance. Due to the severity and repetition of the bowling ball striking the pit cushion, the integrity of follower link assembly 68 has been known to deteriorate at an undesirable rate. The follower link assembly parts are used to control the position of the pit cushion prior to bowling ball impact, making the follower link assembly components susceptible to the severity of bowling ball impact. The pivot point of the pivot links 74 eventually degrades at the point of connection with the steel spacers 82 due to the severity of bowling ball impact and lack of adequate lubrication.

In addition, the urethane pivot rollers of the pivot links harden over time and resist pivoting of the follower link assembly and pit cushion. The follower link assembly part deterioration results in continued restricted pit cushion rotation, which in turn results in reduction of vertical link and triangular plate upward rotation upon bowling ball impact and making more difficult to unlatch the rake trip mechanism to begin the pinsetter operational cycle. As parts of the follower link assembly continue to deteriorate, component rotation continues to be seriously impeded, thus resulting in the need for the follower link assembly replacement to restore the rake trip mechanism performance to satisfactory operable condition.

In addition, the follower links 74 control the forward positioning of the lower end of the pit cushion 42. Due to the pit cushion position, bowling balls are susceptible to getting pinned between the pit cushion and ball lift rod assembly that could result in bowling ball damage and the failure to return the bowling ball back to the bowler.

The need has therefore arisen to provide a pit cushion follower that is simpler, less prone to wear, is less sensitive to part wear, and provides less restriction to pit cushion motion than link-based pit cushion followers.

SUMMARY OF THE INVENTION

In accordance with a first aspect of the invention, at least some of the above-mentioned needs are met through the use of a cam and roller-based pit cushion follower assembly that allows a pit cushion of an automatic pinsetter to move toward and away from a support arm on which the pit cushion is movably mounted without restricting a range of motion of the pit cushion away from the support arm. Preferably, the cam and roller assembly comprises a roller that is configured to be mounted on the support arm, and a cam that is configured to be mounted on the pit cushion at a location in which the cam contacts and rides along the roller when the pit cushion moves toward the support arm from an initial position thereof. At least an outer peripheral surface of the roller preferably is formed from an elastomeric material.

The assembly may additionally include a bolt that is configured to mount the cam on the pit cushion and that is also configured to receive an end of a link that is coupled to a rake assembly of the pinsetter.

A pit cushion incorporating a cam and roller assembly as described above, either as initially assembled or as retrofitted via the replacement of a link-based follower assembly with the cam and roller assembly, includes a support arm, a pit cushion movably supported on the support arm, a roller mounted on the support arm, and a cam mounted on the pit cushion. The cam is operative, upon movement of the pit cushion toward the support arm from an initial position thereof, to ride along the roller while driving the support arm to move. The cam is also operative to permit return movement of the pit cushion to the operative position thereof without restricting the range of motion of the pit cushion.

The pit cushion assembly may additionally be connected to a link that is operable to drive the pit cushion upwardly and rearwardly while the cam rides along the roller. The link typically is responsive to movement of a rake assembly.

In accordance with still another embodiment of the invention, a method is provided of replacing a link-based follower assembly of a pit cushion support assembly with a cam and roller-based follower assembly and of operating the resulting assembly.

Use of a cam and roller-based follower assembly instead of or in place of a link-based follower assembly eliminates all of the follower link assembly components known to fail due to ball impact and lack of adequate lubrication. Pit cushion positioning when the pinsetter is waiting for bowling ball impact (0 degrees) is not dictated by the follower's components and, therefore, is not as susceptible to component deterioration as in prior assemblies due to the severity and repetition of the bowling ball striking the pit cushion. Also, pit cushion rotation is not controlled by the cam and roller-based follower assembly, resulting in less component deterioration. Rotation of the pit cushion is unimpeded until the pit cushion cam meets the elastomeric roller assembly while freely pivoting clockwise. This unimpeded movement results in improved vertical link and triangular plate upward rotation, greatly improving the operation and reliability of the rake trip mechanism to begin the pinsetter cycle. Minimal maintenance and lubrication are required to maintain the integrity of the follower's components.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

Figure 1:
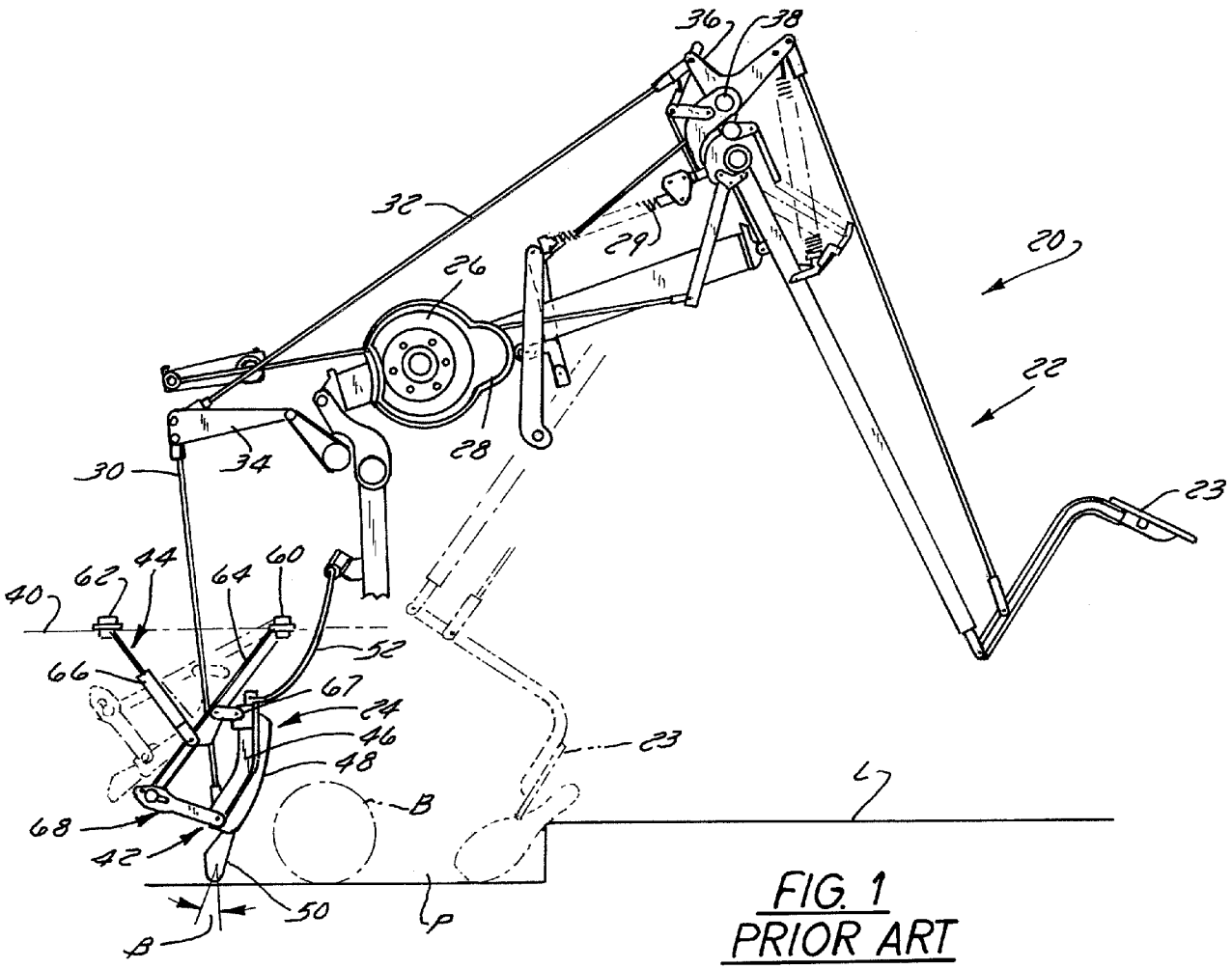
FIG. 1 PRIOR ART
FIG. 1 is a partially schematic side elevation view of a portion of a pinsetter constructed in accordance with the prior art, appropriately labeled "PRIOR ART"

Referring to FIGS. 4–10, a pit cushion assembly 124 (FIGS. 8–10) is provided with a follower assembly 168 that takes the form of a cam and roller-based assembly rather than the traditional link-based assembly. The pinsetter 20 is otherwise unchanged with respect to FIG. 1, and reference will occasionally be made herein to FIG. 1 when referring to pinsetter components other than the pit cushion assembly 124. The pit cushion assembly 124 is also unchanged except for its incorporation of a cam and roller-based follower assembly 168. In fact, the follower assembly 168 is usable as a replacement kit for an existing link-based follower assembly. Components of the pit cushion assembly 124 of FIGS. 4–10 therefore are designated by the same reference numerals as the corresponding components of the pit cushion assembly 24 of FIGS. 1–3, incremented by 100.

Hence, the pit cushion assembly 124 comprises a pit cushion 142 that extends across the lane L and that is suspended by two support assemblies 144, one located at each end of the pit cushion 142 and only one of which is shown. The pit cushion 142 comprises a steel plate 150 protected by pads 148 so as not to mark or damage bowling balls. A bottom end of the plate 150 extends forwardly and downwardly from the pads 148 to a position just above the surface of the pit area P when the pit cushion assembly 142 is in its initial or deactuated position of FIG. 8. A pit curtain 152 extends upwardly from the pit cushion 142 to hide subjects behind the pit cushion from view.

Each support assembly 144 including a support arm 164, a pair of upper support arms 167, and a lower follower assembly 168. The upper end of each support arm 164 of each support assembly 144 is pivotally mounted to one of the front brackets 60 described above in connection with FIG. 1. An airplane type shock absorber 166 is pivotally attached to an intermediate portion of each support arm 164 at one end and to the rear kickback pit cushion-mounting bracket 62 at its opposite end. The shock absorbers 166 relieve the sudden rearward motion of the pit cushion upon ball impact.

The upper support arms 167 and a lower follower assembly 168, in combination with pivoting movement of the support arm 164, permit the pit cushion 142 to swing upwardly and rearwardly upon ball impact so that a bowling ball B can pass under the pit cushion 142 to enter the ball elevator (not shown). They also permit the pit cushion 142 to return to its initial position at the end of a pinsetter's operational cycle. The upper support arms 167 of each support assembly 144 are pivotally mounted to pivot points 170, 172 on the upper end of an associated vertical mounting plate 146 on the pit cushion 142 and an intermediate portion of the support arm 164, respectively. However, as will now be detailed, the follower assemblies 168 do not positively couple the vertical mounting plates 148 to the support arms 164.

Figure 2:
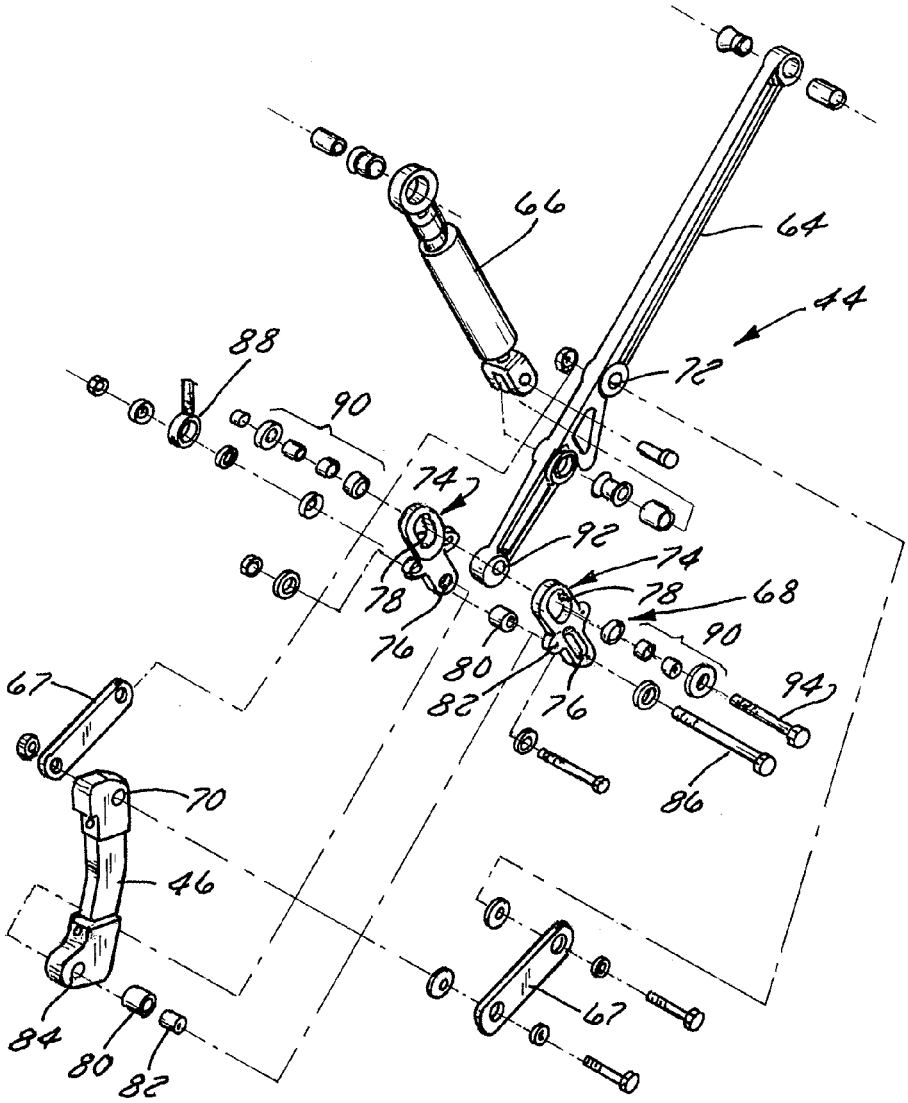
FIG. 2 PRIOR ART
FIG. 2 is an exploded view of the prior art pit cushion support assembly, also appropriately labeled "PRIOR ART"
Figure 6:
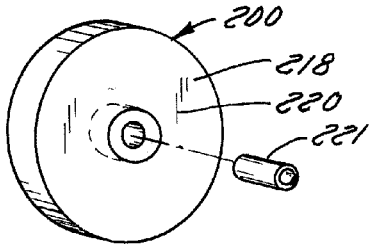
FIGS. 6 and 7 are perspective views of a roller assembly and cam, respectively, of the support assembly of FIGS. 4 and 5.
Figure 7:
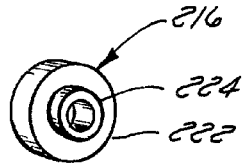
Figure 3:
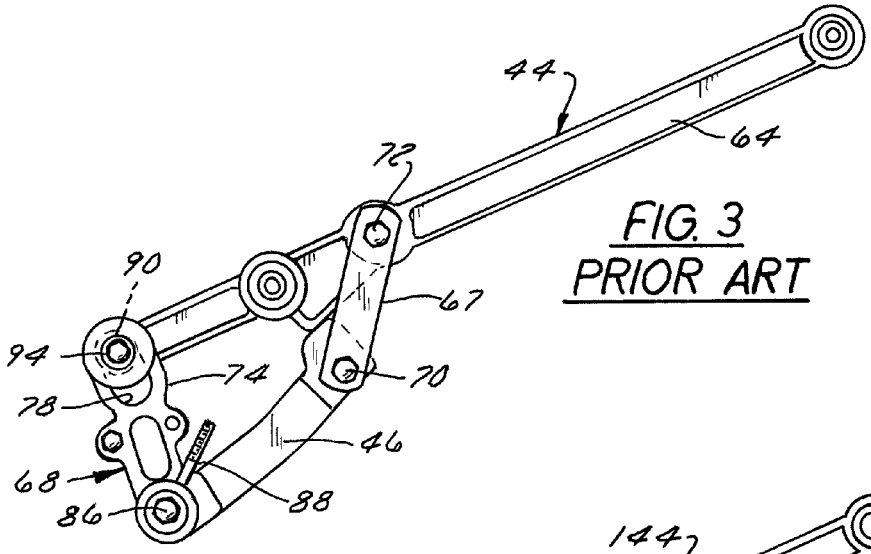
FIG. 3 PRIOR ART
FIG. 3 is a side elevation view of the prior art pit cushion support assembly of FIG. 2.
Figure 4:
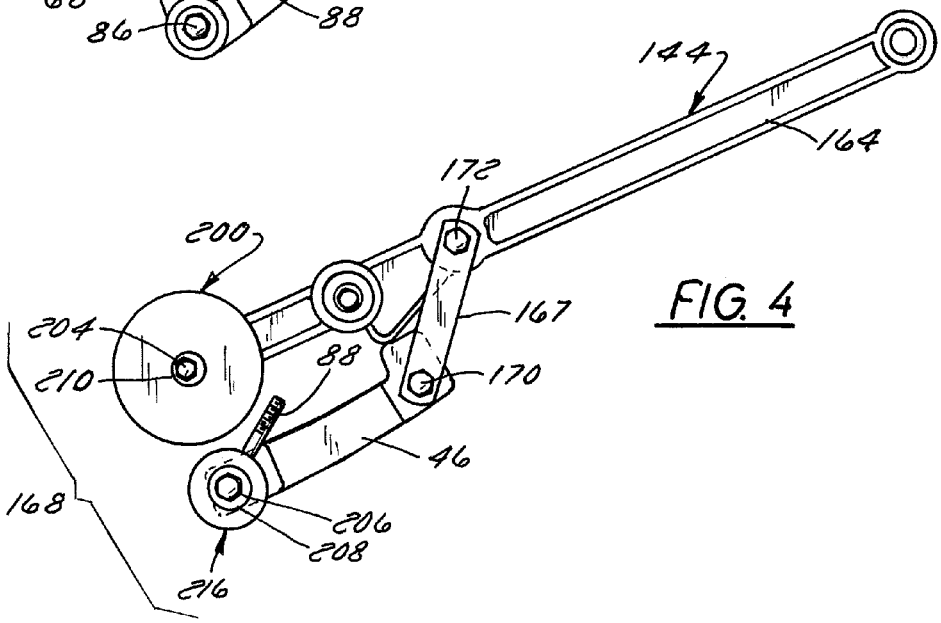
FIG. 4 is a side elevation view of a pit cushion support assembly including a follower assembly constructed in accordance with a preferred embodiment of the invention.
Figure 5:
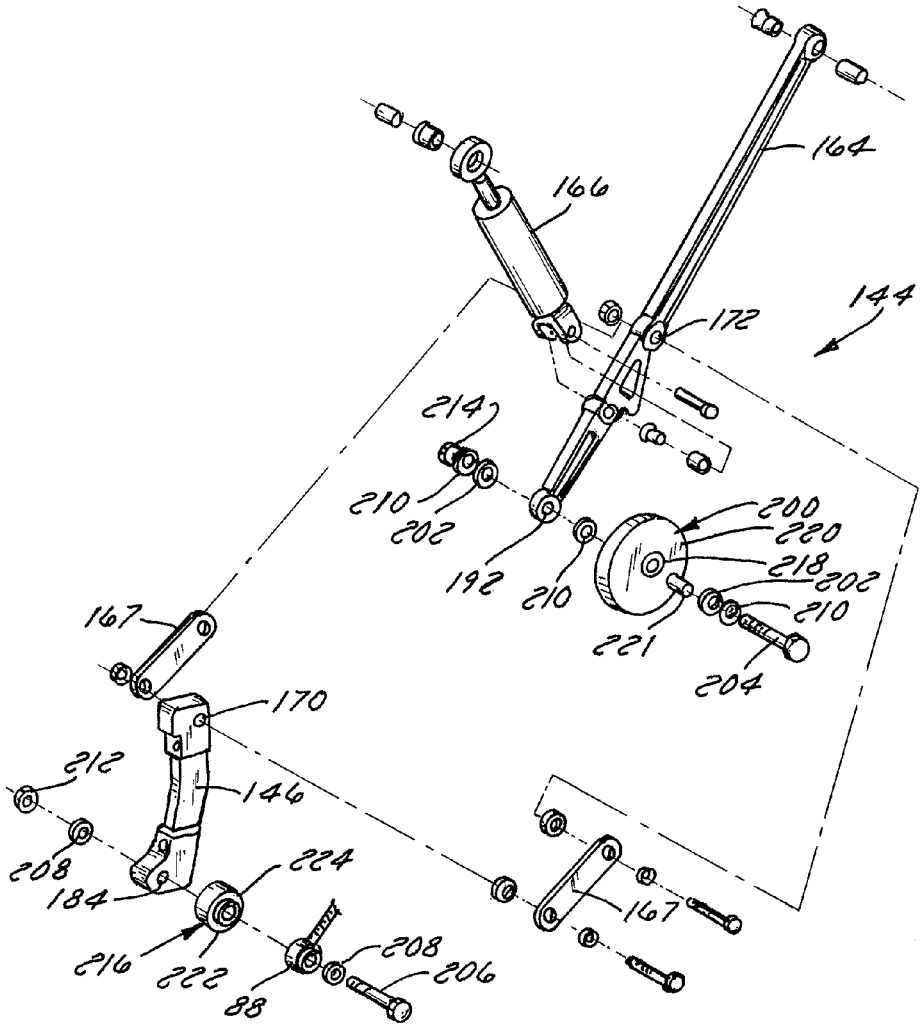
FIG. 5 is an exploded view of the support assembly of FIG. 4.

Referring again to FIGS. 4 and 5, the follower assembly 168 of each support assembly 144 may be installed in an OEM environment or in a retrofit environment in which it replaces all components of the link-based assembly 68 of FIGS. 1–3. It includes one roller assembly 200, two steel spacers 202, one ⅜ inch bolt 204, one ½ inch bolt 206, two half inch washers 208, three ⅜ inch washers 210, one ½ inch cap nut 212, one ⅜ inch cap nut 214, and one pit cushion cam 216. The roller assembly 200 is pivotally mounted on an aperture 192 in the lower end of the support arm by the ⅜ inch bolt 204 and related components. It includes an elastomeric roller 218 and a metal bushing 220 that receives a sleeve 221 that acts as an axial spacer to facilitate free rolling of the roller 218. The elastomeric material of the roller 218, which may for example be a urethane or nylon, cushions impact occurring upon cam engagement, reducing wear to the entire support assembly 144. The cam 216 is fixedly mounted to the aperture 184 in the bottom end of the vertical mounting plate 146 by the ½ inch bolt 206 and related components. Bolt 206 also supports uniball 88 for link 30. The cam 216 includes a cam portion 222 of increased diameter and a spacer portion 224 of smaller diameter (FIG. 7) that extends axially outwardly from the cam portion to serve as a spacer between the cam portion and the uniball 88 for the vertical link 30.

Figure 8:
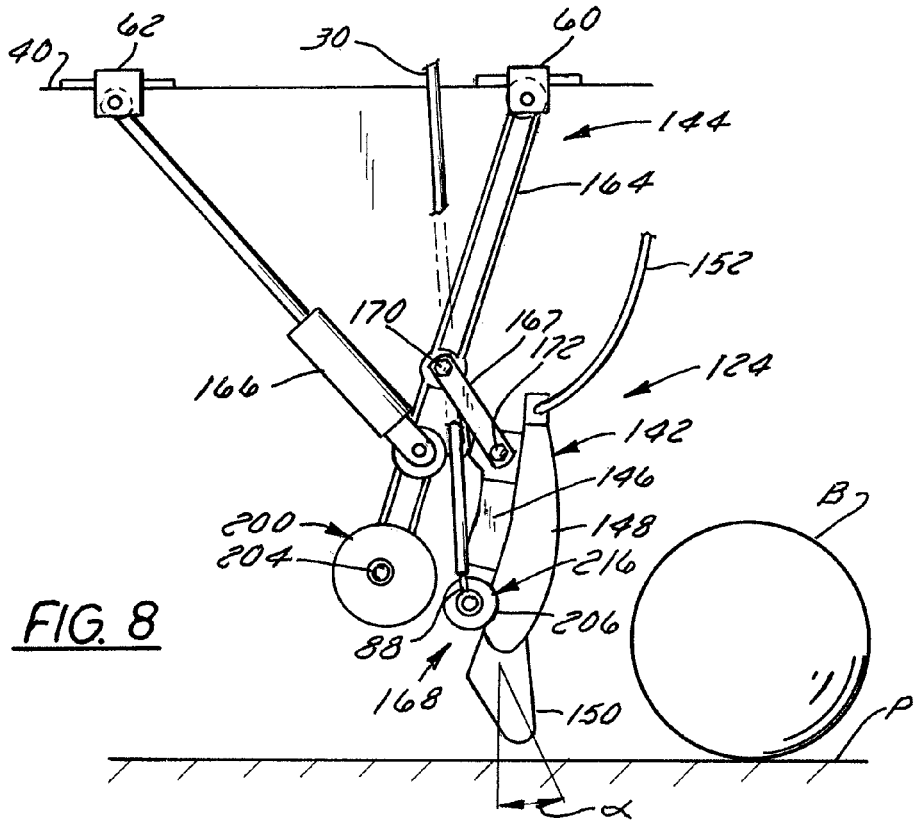
FIGS. 8–10 are a series of side elevation views depicting the range of motion of the pit cushion and one of its associated support assemblies during a pin setting cycle.

After assembly, the pit cushion assembly 142 assumes the initial position illustrated in FIG. 8. At this time, the cam 216 is spaced from the roller assembly 200 and the lower end of the pit cushion plate 150 extends at a positive acute angle $\alpha$ relative to a vertical plane. This is in contrast to a prior pit cushion assembly or even the same pit cushion assembly having a link-based follower assembly in which the positive coupling of the pit cushion to the support arm provided by the link-based follower assembly 68 retains the bottom end of the pit cushion 50 at a negative angle $\beta$ relative to the vertical as seen in FIG. 1. Due to this new orientation of the pit cushion 50, the pinsetter 20 as a whole is more sensitive to ball impact, and the pin setting cycle is thus more easily tripped or initiated by ball impact. The entire pinsetter 20 therefore is more reliable and less accessible to error.

Figure 9:
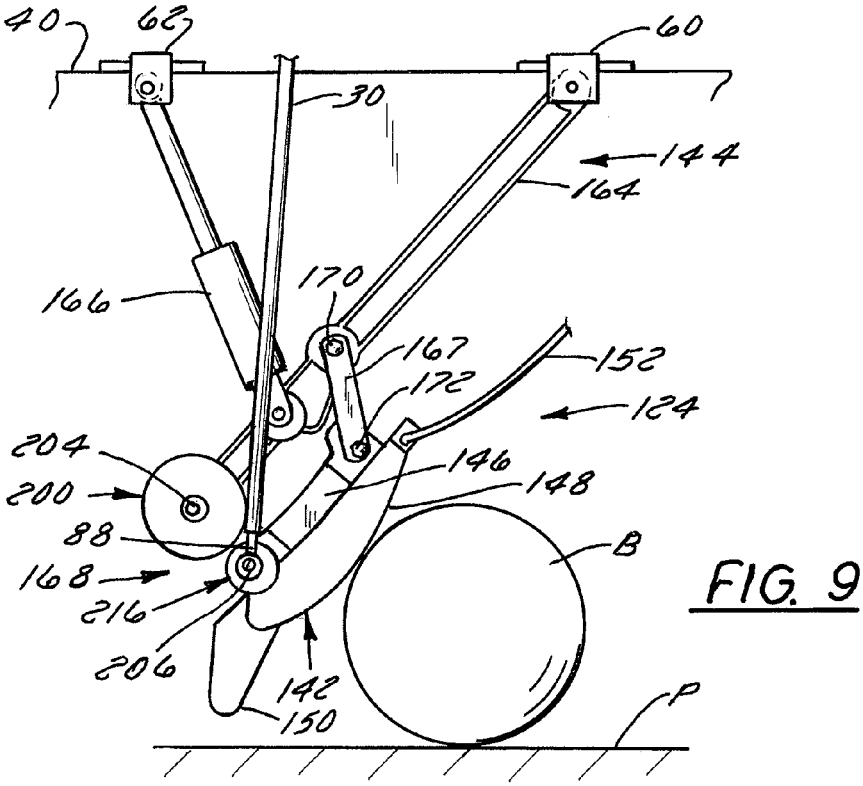
Figure 10:
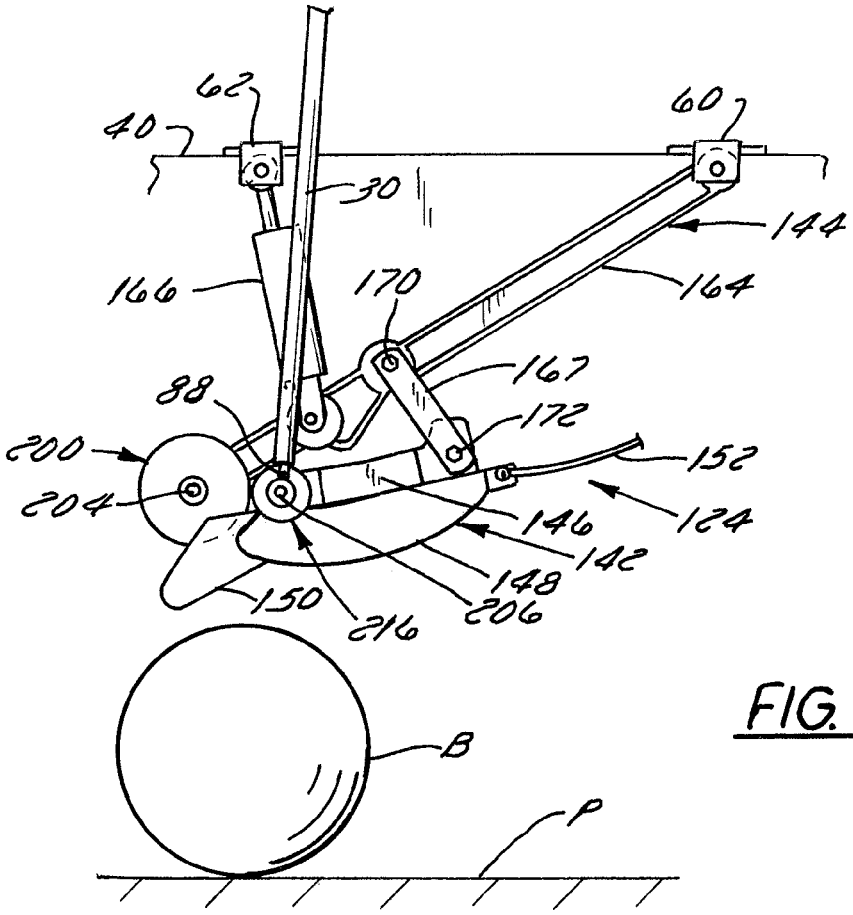

The impact of a ball B against the pit cushion 142 drives the pit cushion 142 to rotate clockwise as seen in FIG. 9, triggering the pin setting cycle, either mechanically via ball impact or electronically via an electronic sensor (not shown). If the triggering is mechanical, movement of the vertical link 30 triggers the "shot gun link" to cause the gearbox 26 to drive the rake assembly 22 to rotate clockwise. Rake assembly rotation pivots the triangular plates 34 through the intervening link 32 (FIG. 1) and drives the vertical link 30 upwardly to pivot the pit cushion 142 upwardly and clockwise. As the pit cushion cam 216 meets the roller assembly 200, the roller assembly 200 stops the movement of the pit cushion 142 to the rear unless the support arm 164 pivots against the action of the shock absorber 166. The roller assembly 200 then rotates, allowing the rake sweep board 23 to lower to the lane surface L as the vertical links 30 drive the triangular plates 34 to rotate (see FIG. 1). As the rake continues to sweep rearward (FIG. 1), the elastomeric roller assembly 200 continues to rotate, allowing the pit cushion cam 216 to move along the roller assembly 200 and the pit cushion 142 to move unimpeded to the full actuated position of FIG. 10. This unimpeded motion permits the pit cushion 142 to rise to a level that is significantly above that which the same pit cushion would have risen with a prior art link-based follower assembly, providing better clearance for bowling ball passage beneath the pit cushion 142 as seen in FIG. 10. The increased stroke of the support arm 164 compresses shock absorber 166 considerably more than is typically found in systems employing link-based follower assemblies (indeed, experience has shown that the shock absorbers of many assemblies comes into play little, if at all). The greater involvement of the shock absorber 166 in operation further reduces impact wear on the system.

As the pinsetter 20 nears the completion of its cycle, the rake sweep board 23 rises, driving the vertical links 30 downwardly through the triangular plates 34, allowing the pit cushion 142 to move downward and forward to return to the initial position of FIG. 8. This motion is completely unrestricted by the follower assemblies 168 due to the lack of any positive connection between the cams 216 and roller assemblies 200.

It can best be seen that the cam and roller-based follower assembly has considerably fewer parts than a conventional link-based follower assembly. It is less prone to failure due to its simplicity and due to the fact that it does not positively couple the pit cushion to the support arm and, thus, is of a considerably less shock and stress. It is also virtually maintenance free. It also increases the stroke of the pit cushion by at least 30° when compared to the same system employing a link-based follower assembly.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept. The scope of still other changes to the described embodiments that fall within the present invention but that are not specifically discussed above will become apparent from the appended claims and other attachments.

The invention claimed is:

1. A pit cushion follower assembly, comprising:

a cam and roller assembly that allows a pit cushion of an automatic pinsetter to move toward and away from a support arm on which the pit cushion is movably mounted without restricting a range of motion of the pit cushion away from the support arm, wherein the cam and roller assembly comprises:

(A) a roller that is configured to be mounted on the support arm;

(B) a cam that is configured to be mounted on the pit cushion at a location in which the cam contacts and rides along the roller when the pit cushion moves toward the support arm from an initial position thereof; and (C) a bolt that is configured to mount the cam on the pit cushion and that is also configured to support an end of a link coupling the pit cushion assembly to a rake assembly.

2. A pit cushion assembly for an automatic pinsetter, comprising:

(A) a first support arm;

(B) a pit cushion that is movably supported on the first support arm via a second support arm having a first end portion connected to the first support arm and a second end portion connected to the pit cushion, the second support arm permitting the put cushion to move toward and away from the first support arm;

(C) a roller that is mounted on the first support arm beneath the first end of the second support arm; and (D) a cam that is mounted on a rear portion of the pit cushion and that is operative (1) upon movement of the pit cushion toward the first support arm from an initial position thereof, to ride along the roller, and (2) to permit return movement of the pit cushion to the operative position thereof without restricting the range of motion of the pit cushion.

3. The assembly of claim 2, wherein at least an outer peripheral surface of the roller is formed from an elastomeric material.

4. The assembly of claim 3, wherein the material is a urethane.

5. A pit cushion assembly for an automatic pinsetter, comprising:

(A) a support arm;

(B) a pit cushion that is movably supported on the support arm;

(C) a roller that is mounted on the support arm; and (D) a cam that is mounted on the pit cushion and that is operative (1) upon movement of the pit cushion toward the support arm from an initial position thereof, to ride along the roller, and (2) to permit return movement of the pit cushion to the operative position thereof without restricting the range of motion of the pit cushion, further comprising a bolt that mounts the cam on the pit cushion and that supports an end of a link that couples the pit cushion assembly to a rake assembly.

6. The assembly of claim 2, wherein the cam is fixedly mounted on the pit cushion.

7. The assembly of claim 2, further comprising a link that is coupled to the pit cushion assembly and that is operable to drive the pit cushion upwardly and rearwardly while the cam rides along the roller.

8. The assembly of claim 7, further comprising a pin rake assembly which is coupled to the link and which, through the link, drives the pit cushion to move through at least parts of actuation and return stroke thereof.

9. The assembly of claim 2, further comprising a shock absorber that is connected to the first support arm beneath the first end of the second support arm.

10. The assembly of claim 2, wherein, in the initial position thereof, a lower tip of the pit cushion extends at an acute positive angle relative to a vertical line.

11. The assembly of claim 2, wherein the first and second support arms, the roller, and the cam are located at a first end of the pit cushion, and further comprising third and fourth support arms, a second roller, and a second cam at a second end of the pit cushion.

12. A method comprising:

(A) removing a follower link assembly from a pit cushion assembly of a pinsetter, the follower link assembly being pivotally coupled to a pit cushion at a front end thereof and to a support arm at rear arm at a rear end thereof in a manner that allows motion of the pit cushion away from the support arm through a restricted range; and (B) mounting a cam and roller assembly on the pit cushion assembly that allows motion of the pit cushion away from the support arm without restricting the range of pit cushion motion.

13. The method as recited in claim 12, wherein the mounting step comprises mounting a roller on one of the support arm and the pit cushion and mounting a cam on the other of the support arm and the pit cushion, the cam and roller being dimensioned such that the cam is spaced from the roller when the pit cushion is in an initial position thereof and contacts and rides along the roller when the pit cushion moves toward the support arm.

* * * * *